US007568857B2

(12) United States Patent
Riotto

(10) Patent No.: US 7,568,857 B2
(45) Date of Patent: Aug. 4, 2009

(54) ANTI-BREAK-THROUGH BARRIER

(75) Inventor: Luciano Riotto, Fiume Veneto (IT)

(73) Assignee: Cos.Me. Costruzioni Metalliche SRL, Fiume Veneto (PN) (IT)

( * ) Notice: Subject to any disclaimer, the term of this patent is extended or adjusted under 35 U.S.C. 154(b) by 114 days.

(21) Appl. No.: 11/662,159

(22) PCT Filed: Sep. 7, 2005

(86) PCT No.: PCT/EP2005/054424

§ 371 (c)(1),
(2), (4) Date: Mar. 7, 2007

(87) PCT Pub. No.: WO2006/027371

PCT Pub. Date: Mar. 16, 2006

(65) Prior Publication Data

US 2007/0264078 A1 Nov. 15, 2007

(30) Foreign Application Priority Data

Sep. 8, 2004 (IT) ..... UD20040038 U

(51) Int. Cl.
*E01F 13/00* (2006.01)

(52) U.S. Cl. ..... 404/6; 49/33; 49/131

(58) Field of Classification Search ..... 404/6; 256/13.1; 49/49, 131, 133, 103, 33, 34
See application file for complete search history.

(56) References Cited

U.S. PATENT DOCUMENTS 1,632,360 A * 6/1927 Wilson ..... 296/24.37
2,794,498 A * 6/1957 Heckerman ..... 160/62
2,805,046 A * 9/1957 Petterson ..... 256/25
2,967,567 A * 1/1961 Heckerman ..... 160/62
3,101,929 A * 8/1963 Dvore ..... 256/24
3,228,361 A * 1/1966 Ritter ..... 109/84
3,698,465 A * 10/1972 Aberg ..... 160/222
3,960,196 A * 6/1976 Berner ..... 160/222
4,133,158 A * 1/1979 Ting ..... 52/478
4,292,882 A * 10/1981 Clausen ..... 89/36.02
4,351,558 A * 9/1982 Mueller ..... 296/203.01
4,652,042 A * 3/1987 Bader ..... 296/186.4
4,822,207 A * 4/1989 Swahlan ..... 404/6
4,822,657 A * 4/1989 Simpson ..... 428/69
4,922,655 A * 5/1990 Seal ..... 49/131
5,118,056 A * 6/1992 Jeanise ..... 246/127
5,630,572 A * 5/1997 Guay ..... 256/1

(Continued)

FOREIGN PATENT DOCUMENTS

DE 19 00 583 8/1970

(Continued)

*Primary Examiner*—jGary S Hartmann
(74) *Attorney, Agent, or Firm*—Hamre, Schumann, Mueller & Larson, P.C.

(57) ABSTRACT

Anti-break-through safety barrier able to be used in correspondence with a site to be protected. The anti-break-through safety barrier comprises a plurality of modular elements coupled together so as to slide vertically with respect to the other. Each modular element comprises a stiff and armor-plated protecting wall, which is fixed laterally to a pair of supports. Each modular element is further movable between an inactive position, located below a determined trampling reference plane and a lifted position above the trampling reference plane to define a single compact protecting structure, stiff and armor-plated, anchored to the floor or to the ground.

8 Claims, 4 Drawing Sheets

U.S. PATENT DOCUMENTS

| | | | | |
|---|---|---|---|---|
| 5,993,104 | A * | 11/1999 | Marcotullio et al. | 404/6 |
| 6,162,057 | A * | 12/2000 | Westphal et al. | 434/11 |
| 6,227,523 | B1 * | 5/2001 | Haberlen | 256/59 |
| 7,067,031 | B2 * | 6/2006 | deWitt | 156/250 |
| 7,146,345 | B2 * | 12/2006 | Weik et al. | 705/418 |
| 7,329,067 | B1 * | 2/2008 | Rodriguez | 404/6 |
| 2007/0183845 | A1 * | 8/2007 | Lewis | 404/6 |

FOREIGN PATENT DOCUMENTS

| | | |
|---|---|---|
| EP | 1 327 740 | 7/2003 |

* cited by examiner

ANTI-BREAK-THROUGH BARRIER

FIELD OF THE INVENTION

The present invention concerns an anti-break-through safety barrier able to be used in correspondence with a site to be protected, that is to say, any place whatsoever, or public and private building, such as for example a port, an airport, a place of worship, an archeological site, or other.

To be more exact, the barrier according to the present invention comprises one or more armor-plated vertical walls. Each wall is movable between an inactive position, in which it is below the road surface and thus allows people and vehicles to transit, and a lifted, or raised, position in which it functions as a real barrier to the entrance to the site to be protected.

BACKGROUND OF THE INVENTION

An anti-break-through safety barrier is known, which comprises a protecting wall hinged to a fixed part, and movable between a horizontal position aligned with the road surface, and a vertical position orthogonal to the first position.

This known barrier has the disadvantage that it does not guarantee adequate protection, since the movable protecting wall can easily be knocked down, especially by using a vehicle. Moreover, the protecting wall is relatively low and easy to climb over.

EP-B-1327740 discloses a stepped door, in particular a fire-protection door, comprising several door sections, movable between an inactive position, in which they are lifted in an upper edge of the passage, and a closed position, in which they are lowered to protect an area in case of fire. This known stepped door has the drawback to need a dedicated bearing structure, like a wall, an arch, or a pillar, to bear the heavy door sections, so rendering the entire device very cumbersome and expensive.

Furthermore, U.S. Pat. No. 2,805,046 describes a collapsible guard fence, which is movable between an inactive position, beneath the surface of the ground, and an elevated position for protecting selected areas against trespass. However, this known fence is so light and weak that is not able to resist against possible knocks caused by moving vehicles.

One purpose of the present invention is to achieve an anti-break-through safety barrier guaranteed to be substantially impassable, and which will resist against possible knocks caused by moving vehicles, so to define a compact, stiff, and armor-plated protecting structure.

A further purpose of the present invention is to achieve an anti-break-through safety barrier which can have a variable height with substantial continuity and which in its maximum extension will considerably reduce the risk of anyone climbing over.

The Applicant has devised, tested and embodied this invention to overcome the shortcomings of the state of the art and to obtain these and other purposes and advantages.

SUMMARY OF THE INVENTION

The present invention is set forth and characterized in the main claim, while the dependent claims describe other characteristics of the invention or variants to the main inventive idea.

In accordance with the above purposes, an anti-break-through safety barrier is able to be used in correspondence with a site to be protected.

According to a feature of the present invention, the barrier comprises a plurality of modular elements coupled together so as to slide vertically one with respect to the other. Each modular element comprises a stiff and armor-plated protecting wall, which is fixed laterally to at least a pair of supports.

Furthermore, each modular element is movable between an inactive position, located below a determined trampling reference plane, and a lifted position above the trampling reference plane, to define a single compact protecting structure, stiff and armor-plated, anchored to the floor or to the ground.

In this way, the safety barrier according to the present invention, thanks to the pair of supports, offers a high level of protection, much greater than that provided by known barriers, thus guaranteeing that the barrier is substantially impassable, and will resist against possible knocks caused by moving vehicles.

The modular elements define a telescopic structure that is movable, for example by means of fluid-dynamic or electromechanical means, between the inactive position, allowing vehicles and people to transit, and the lifted position, defining said single compact protecting structure, stiff and armor-plated, and acting as a real barrier to the entrance to the site to be protected.

By raising one or more modular elements, the height of the barrier according to the present invention can be adjusted, linearly and with substantial continuity, between the inactive position and the lifted position.

According to a variant, the protecting walls are able to slide vertically one next to the other and each of said pairs of supports is able to slide vertically, inserting itself inside another pair.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
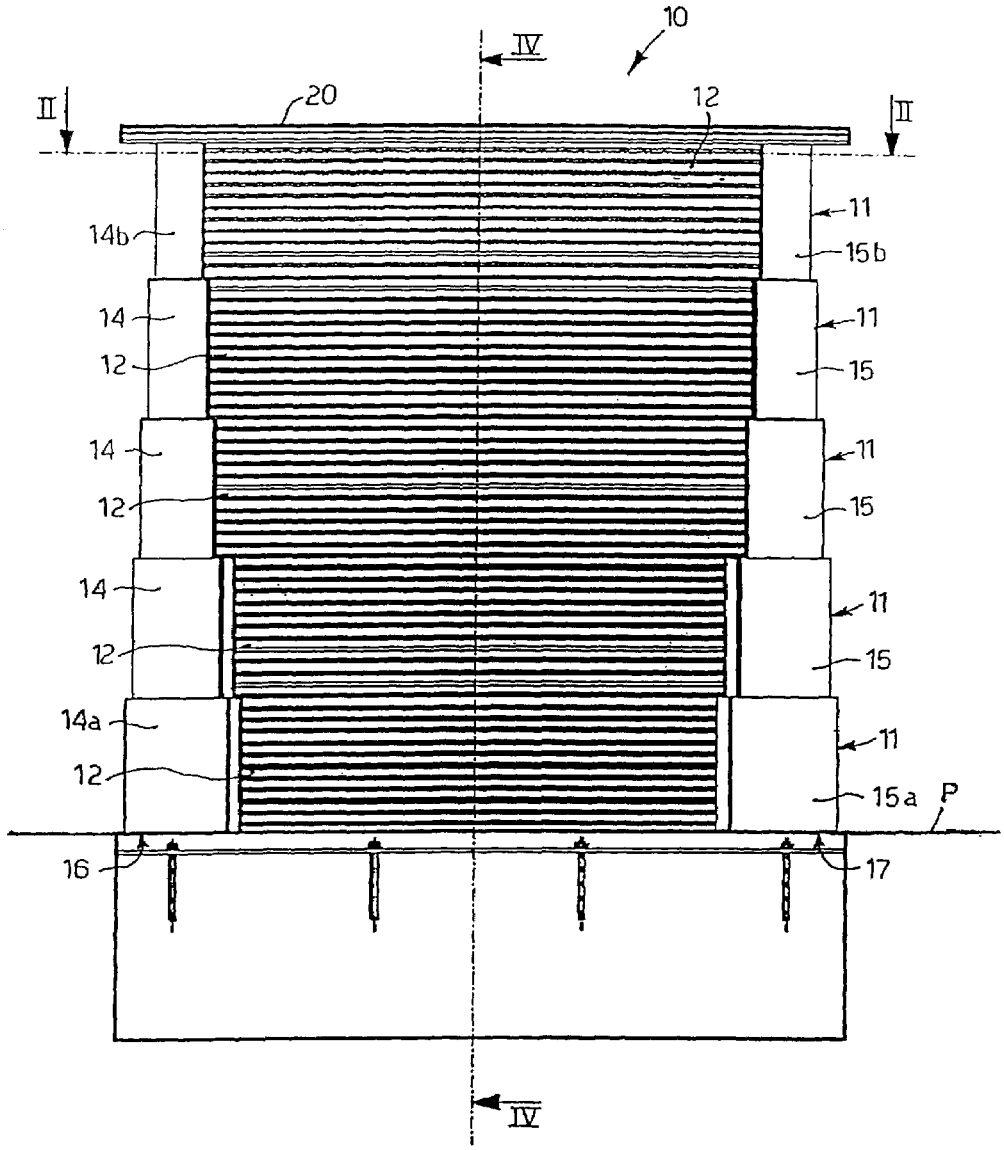
FIG. 1 is a front view of an anti-break-through safety barrier according to the present invention, in a lifted position.
Figure 2:
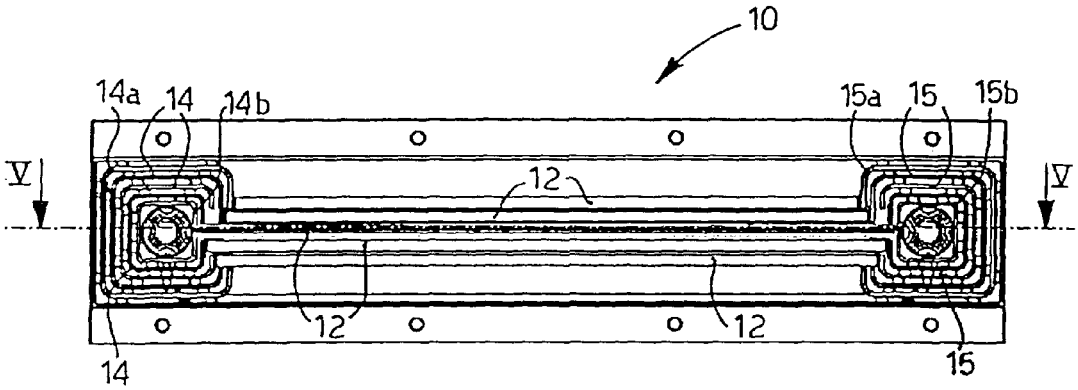
FIG. 2 is a section from II to II of FIG. 1.

With reference to FIG. 1, an anti-break-through safety barrier 10 according to the present invention is used in correspondence with a site to be protected.

The safety barrier 10 has a width varying between about 2000 and 6000 mm and comprises for example five modular elements 11, coupled together so as to slide vertically one with respect to the other in order to obtain a maximum height that, according to the size of the individual modular elements 11, can vary from about 1000 mm to about 3000 mm.

Each modular element 11 comprises a stiff and armor-plated protecting wall 12 and a pair of supports 14, 14*a*, 14*b*, 15, 15*a* and 15*b* respectively first and second. To be more exact, the supports 14*a*, 15*a* are at the base of the safety barrier 10, and the supports 14*b*, 15*b* are at the top of the safety barrier 10.

Each protecting wall 12 is made of stiff and armor-plated sheet metal, for example with ribs; it is arranged vertically, that is, perpendicular to the ground, has a height of between about 200 mm and 600 mm, but can even be about 1000 mm, and is attached at the sides to a respective pair of supports 14, 14*a*, 14*b*, 15, 15*a* and 15*b*.

The totality of the first and second supports 14, 14*a*, 14*b*, 15, 15*a* and 15*b* define two corresponding supporting structures 16, 17, respectively first and second.

Each protecting wall 12 is able to slide vertically one next to the other and each pair of supports 14, 14*a*, 14*b*, 15, 15*a* and 15*b* is able to slide vertically, inserting itself inside another pair.

The supports 14, 14*a*, 14*b*, 15, 15*a* and 15*b* of two adjacent modular elements 11 have different transverse sizes, so that the upper support 14, 14*b*, 15 and 15*b* can be inserted inside the lower support 14, 14*a*, 15 and 15*a*.

To give an indication, the supports 14*a*, 15*a* have a width of about 500 mm, while the supports 14*b*, 15*b* have a width of between about 100 and 200 mm.

The protecting walls 12 of the different modular elements 11 have a width that increases gradually from the bottom towards the top and is comprised between about 6000 mm and about 1000 mm.

Figure 4:
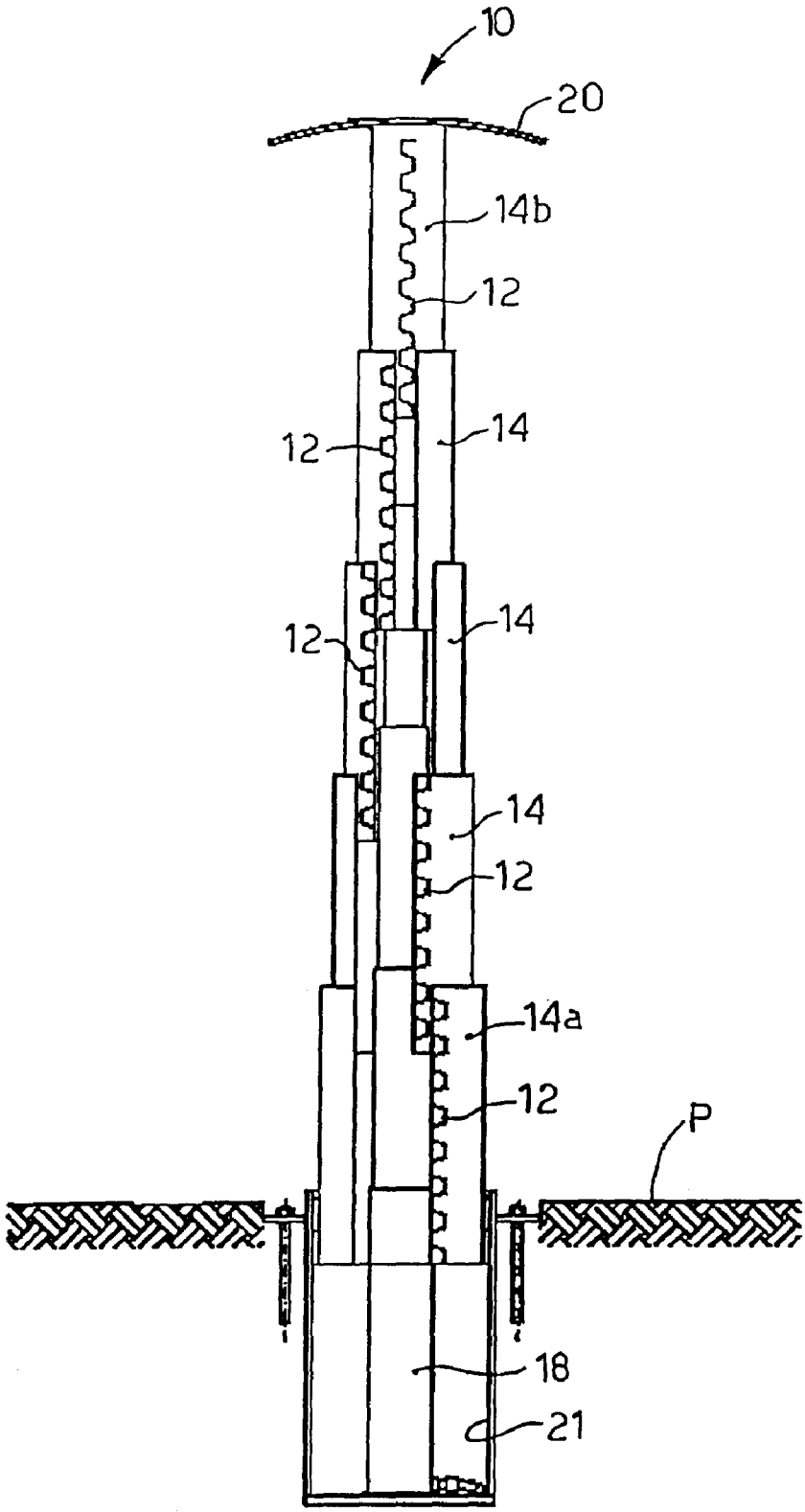
FIG. 4 is a lateral section from IV to IV of FIG. 1.
Figure 5:
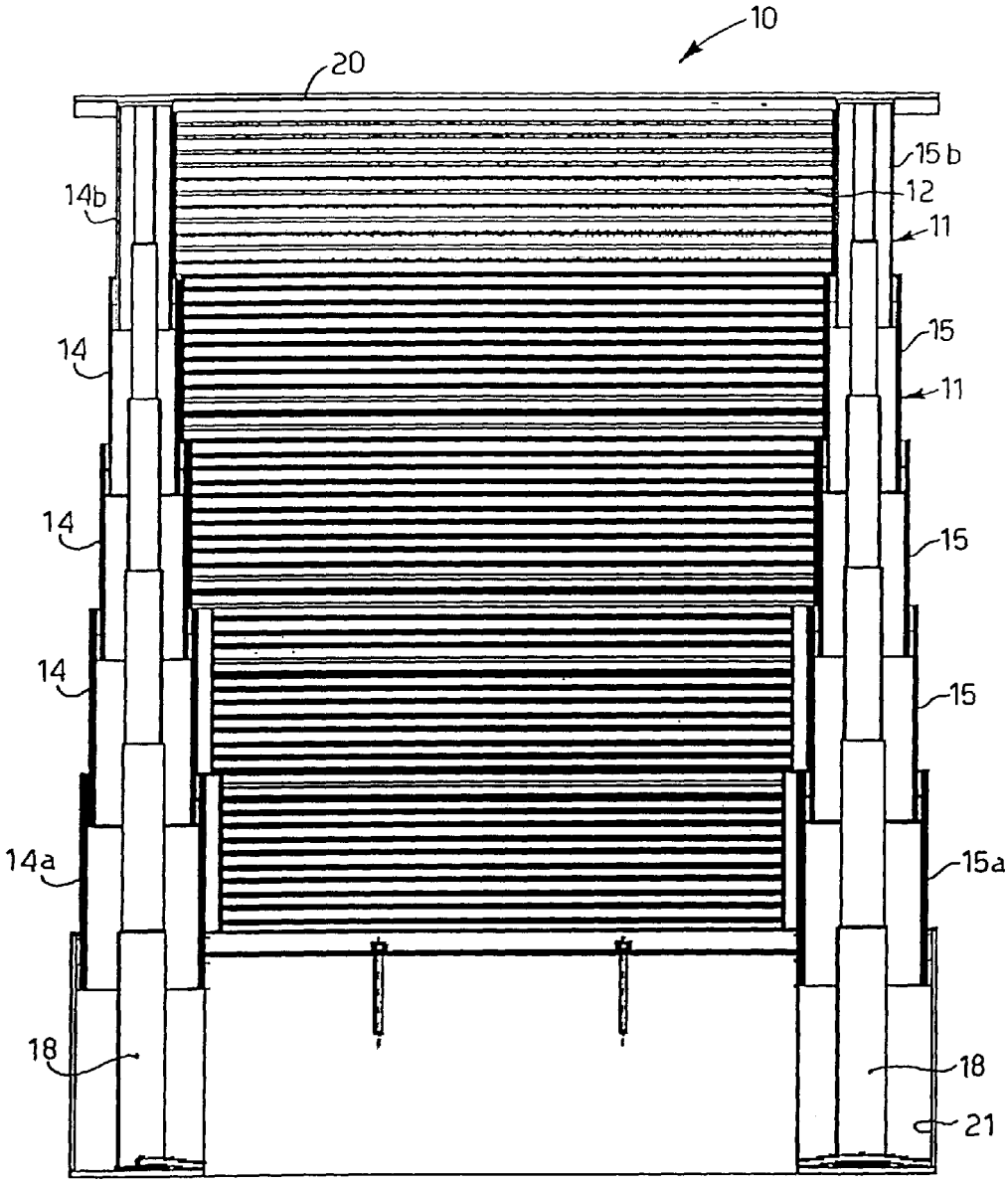
FIG. 5 is a front section from V to V of FIG. 2.

The modular elements 11 therefore define a telescopic structure, moved by means of a hydraulic jack 18 (FIGS. 3, 4 and 5) for each of the supporting structures 16, 17.

According to other solutions that are not shown here, and instead of the hydraulic jack 18, an electric motor with an endless screw is provided, or a linear motor associated with a pantograph.

It is clear that any other mechanical or electromechanical system can be used in order to move the telescopic structure.

Each of the top supports 14*b*, 15*b* is attached inside the respective hydraulic jack 18. When the two hydraulic jacks 18 are lifted, they lift all the supports 14, 14*a*, 14*b*, 15, 15*a* and 15*b* one after the other, and with them the respective protecting walls 12.

When the two hydraulic jacks 18 are lowered, they consequently lower, one after the other, all the supports 14, 14*a*, 14*b*, 15, 15*a* and 15*b* and with them the respective protecting walls 12.

Figure 3:
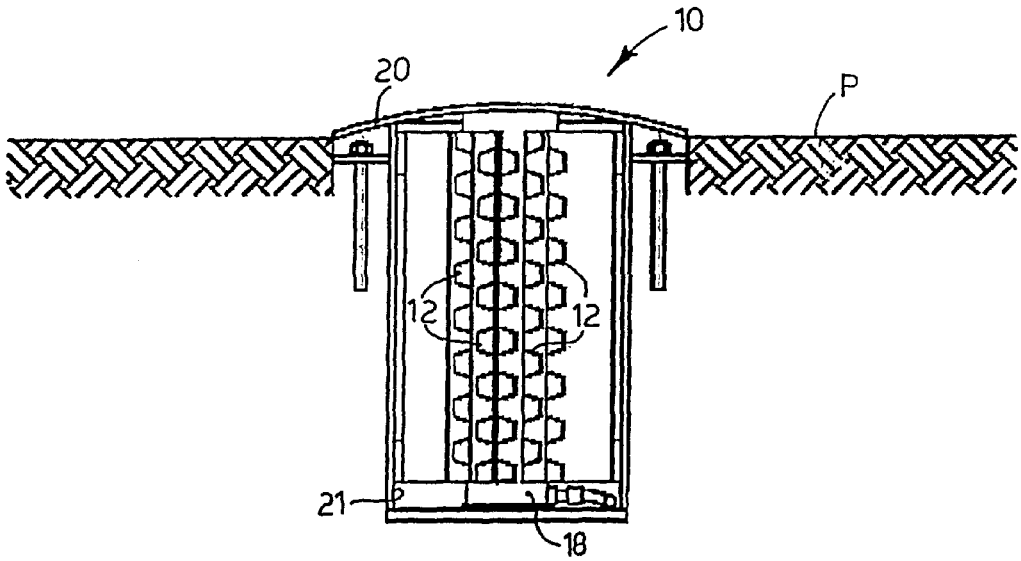
FIG. 3 is a lateral section of the barrier in FIG. 1, in an inactive position.

The telescopic structure is therefore movable between a lifted position (FIGS. 1, 4, 5) and an inactive position (FIG. 3).

In the inactive position the hydraulic jack 18 is lowered and consequently the modular elements 11 are lowered below a determined trampling reference plane P, which defines, for example, the level of the road, and are contained inside a compartment 21 made under the road surface.

The compartment 21 has variable sizes according to the sizes of the various modular elements 11 and such as to contain the safety barrier 10 in the inactive position.

In the lifted position the hydraulic jack 18 is raised and the modular elements 11 are raised above the trampling reference plane P to define a single compact protecting structure, stiff and armor-plated, anchored to the floor or to the ground. In this way, in the lifted position the safety barrier 10 defines a real barrier to the entrance to the site to be protected.

A metal cover 20 is attached to the top supports 14*b*, 15*b* which, in the inactive position, for example, protrudes with respect to the level of the road surface by about 61 mm, thus allowing people and vehicles to pass over it.

It is clear that modifications and/or additions of parts may be made to the safety barrier 10 as described heretofore, without departing from the field and scope of the present invention.

The invention also provides to achieve safety barriers 10 comprising a number of modular elements 11 other than five.

It is also clear that, although the present invention has been described with reference to some specific examples, a person of skill in the art shall certainly be able to achieve many other equivalent forms of anti-break-through safety barrier, having the characteristics as set forth in the claims and hence all coming within the field of protection defined thereby.

The invention claimed is:

1. An anti-break-through safety barrier able to be used in correspondence with a site to be protected, comprising a plurality of modular elements coupled together so as to slide vertically one with respect to the other, wherein each of said modular elements comprises a stiff and armor-plated protecting wall, which is fixed laterally at both its ends to a pair of opposed supports, and wherein each of said modular elements is movable between an inactive position, located below a determined trampling reference plane (P) defined by a road surface, and a lifted position above said trampling reference plane (P) to define a single compact protecting structure, stiff and armor-plated, anchored to the floor or to the ground, wherein said modular elements define a telescopic structure able to slide vertically one inside the other, and wherein each pair of said supports include portions which also telescope and are able to slide vertically one inside another, and wherein in the inactive position all the modular elements and the supports are lowered below said reference plane (P) and are contained inside a compartment made under the road surface.

2. An anti-break-through safety barrier as in claim 1, wherein the supports have transverse sizes decreasing from the bottom to the top of the barrier, and the walls have width increasing from the bottom to the top of the barrier.

3. An anti-break-through safety barrier as in claim 1, wherein a metal cover is attached to the top supports which, in the inactive position of the barrier, slightly protrudes with respect to the level of the road surface thus allowing people and vehicles to pass over it.

4. An anti-break-through safety barrier as in claim 1, wherein said telescopic structure is moved by means of fluid-dynamic means.

5. An anti-break-through safety barrier as in claim 4, wherein said fluid-dynamic means comprises at least a jack connected to the top supports of the barrier and selectively liftable for moving the barrier from its inactive lowered position located under the road surface to its active lifted position above the road surface.

6. An anti-break-through safety barrier as in claim 1, having a width comprised at least between about 2000 mm and about 6000 mm, and a depth comprised at least between about 500 mm and about 1000 mm.

7. An anti-break-through safety barrier as in claim 1, wherein said protecting walls have a height varying at least between about 200 mm and about 1000 mm and a width varying at least between about 1000 mm and about 6000 mm.

8. An anti-break-through safety barrier as in claim 1, wherein the supports of each of said pair of supports have a width varying at least between about 100 mm and about 500 mm.

* * * * *